US008651700B2

(12) United States Patent
Peng

(10) Patent No.: US 8,651,700 B2
(45) Date of Patent: Feb. 18, 2014

(54) LED LIGHT STRING

(75) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 99 days.

(21) Appl. No.: 13/432,656

(22) Filed: Mar. 28, 2012

(65) Prior Publication Data

US 2012/0268938 A1 Oct. 25, 2012

(30) Foreign Application Priority Data

Apr. 20, 2011 (TW) ..... 100206983 U

(51) Int. Cl.
*F21S 4/00* (2006.01)
*H01R 33/00* (2006.01)

(52) U.S. Cl.
USPC ..... 362/249.06; 362/653; 362/659

(58) Field of Classification Search
USPC ..... 362/249.02, 249.06, 249.14, 391, 640, 362/649, 650, 652, 653, 654, 657, 658, 362/659; 439/602, 603
See application file for complete search history.

(56) References Cited

U.S. PATENT DOCUMENTS

| | | | | |
|---|---|---|---|---|
| 5,626,415 | A * | 5/1997 | Huang | 362/391 |
| 7,114,841 | B2 * | 10/2006 | Aanegola et al. | 362/640 |
| 8,083,381 | B2 * | 12/2011 | Tsai | 362/249.02 |
| 8,231,261 | B2 * | 7/2012 | Gherardini et al. | 362/652 |
| 2010/0254161 | A1 * | 10/2010 | Liu et al. | 362/654 |

* cited by examiner

*Primary Examiner* — Y My Quach Lee
(74) *Attorney, Agent, or Firm* — Chun-Ming Shih; HDLS IPR Services

(57) ABSTRACT

A LED lamp string includes a base, a plurality of electrical conductive elements, a light-emitting diode and a shroud. The base has a peripheral wall and an accommodating space formed inside the periphery wall. The peripheral wall is provided with a plurality of through-holes. The electrical conductive elements penetrate the through-holes respectively. Each electrical conductive element includes an electrical wire and an electrical conductive pin. The light-emitting diode is fixedly received in the accommodating space and has a plurality of metallic supports corresponding to the electrical conductive pins. The electrical conductive pins are electrically connected to the metallic supports. The shroud is assembled with the base. By this arrangement, the components of the light string can be detached and assembled easily, so that the user can replace and repair the damaged component easily. Thus, the lifetime of the light string is increased.

10 Claims, 7 Drawing Sheets

LED LIGHT STRING

BACKGROUND OF THE INVENTION

1. Field of the Invention

The present invention relates to a light string, and in particular to a LED light string.

2. Description of Prior Art

During special festivals or celebrations, light strings are used in some special places such as wedding ceremonies, activities and family parties for decorative purpose. People often hang light strings on trees, walls, ceilings or eaves for emitting shining light to thereby increase the happy moods in the festival or celebration. Alternatively, in a stage, selling or exhibition plate, the light strings are arranged in a special configuration such a Chinese or English character or other patterns for advertisement, thereby attracting people's attention. Since the light strings can be used repeatedly, they have been used more and more popularly.

Since light-emitting diodes (LED) consume less electricity and have a cheap price, they have been widely accepted by the public. Thus, the manufacturers in this field propose various LED light strings. The conventional LED light string includes a light-emitting diode, a base and a shroud. The light-emitting diode and electrical wires are connected and accommodated in the lamp base. The shroud covers the outer periphery of the base for protecting the light-emitting diode. The electrical connection between the light-emitting diode and the electrical wire is achieved in the following manner. Electrode terminals of the light-emitting diode are configured as two metallic posts. Thus, the light-emitting diode is fixedly connected to the electrical wire by a soldering process, thereby achieving the electrical connection between the light-emitting diode and the electrical wire.

However, the light-emitting diodes of the conventional LED light string are soldered to the electrical wire and thus the soldered LED cannot be detached easily. As a result, if one of the light-emitting diodes is damaged, the whole set of the LED lamp string has to be discarded, which causes a waste of components. On the other hand, if the damaged light-emitting diode is to be replaced, the shroud has to be detached and the damaged light-emitting diode is pulled out of the base. Then, the soldering portion between the light-emitting diode and the electrical wire has to be melted by using a heat source, whereby the damaged light-emitting diode can be removed from the base. Thus, replacing the damaged light-emitting diode in the conventional LED light string involves complicated and uneasy steps, which takes a lot of time and labors.

In view of the above, the present Inventor proposes a novel and reasonable structure based on his expert knowledge and deliberate researches.

SUMMARY OF THE INVENTION

The present invention relates to a LED light string, in which the respective parts of the light string can be detached and assembled easily. Thus, the user can replace or repair the damaged LED to thereby increase the lifetime of the light string.

The present invention relates to a LED lamp string, which includes: a base having a peripheral wall and an accommodating space formed inside the periphery wall, the peripheral wall being provided with a plurality of through-holes; a plurality of electrical conductive elements penetrating the through-holes respectively, each electrical conductive element comprising an electrical wire and an electrical conductive pin; a light-emitting diode fixedly received in the accommodating space, the light-emitting diode having a plurality of metallic supports corresponding to the electrical conductive pins, the electrical conductive pins being electrically connected to the metallic supports; and a shroud assembled with the base.

The present invention has the following advantageous features. The base, the electrical conductive elements, the light-emitting diode, and the shroud of the light string of the present invention can be detached and assembled easily. Thus, when the light-emitting diode is damaged, the user can replace and repair the damaged light-emitting diode easily, thereby increasing the lifetime of the light string. Alternatively, the light string can be modified or re-arranged based on the user's demands, thereby increasing the range of use and its decorative effect. Further, in the light string of the present invention, a signal transmission line can be used to input/output data to a driving chip of the light-emitting diode to thereby control a light-emitting chip of the light-emitting diode. In this way, a plurality of light-emitting diodes of the light string can emit light randomly or synchronously to generate various effects. Even, the LED light string of the present invention can generate a special lighting effect based on the user's creative thought. Further, the light-emitting diode and the electrical conductive elements are electrically connected firmly, so that the yield of the light string of the present invention is increased.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
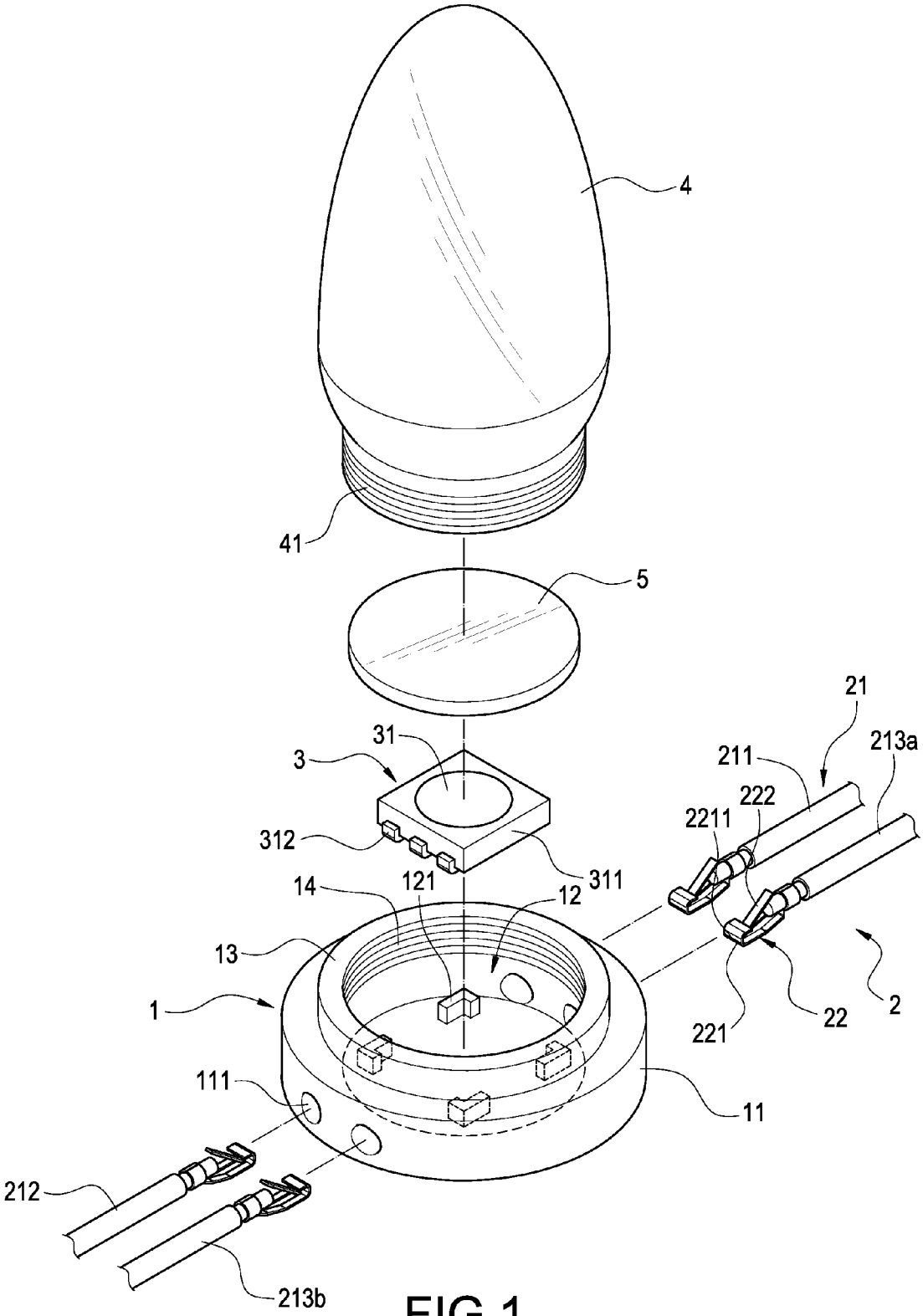
FIG. 1 is an exploded perspective view of the LED light string of the present invention.

Please refer to FIG. 1. The present invention provides a LED light string, which includes a base 1, a plurality of electrical conductive elements 2, a light-emitting diode 3, and a shroud 4.

The base 1 is formed into a cylindrical body, but it is not limited thereto. The base 1 has a peripheral wall 11 and an accommodating space 12 formed inside the peripheral wall 11. The peripheral wall 11 is provided with a plurality of through-holes 111. The base 1 is formed with a positioning portion 121 in the accommodating space 12. One side of the base 1 has an open end 13 provided with inner threads 14. As shown in FIG. 1, the through-holes 111 are arranged in parallel to each other on two opposite sides of the peripheral wall 11. The positioning portion 121 is constituted of four L-shaped corner blocks, but it is not limited thereto.

The electrical conductive elements 2 penetrate the through-holes 111 respectively. Each electrical conductive element 2 comprises an electrical wire 21 and an electrical conductive pin 22. Each electrical conductive pin 22 is fixed to one end of each electrical wire 21 to be accommodated in the base 1. Each electrical wire 21 includes a positive voltage line 211, a negative voltage line 212, a signal input line 213*a*, and a signal output line 213*b*. The electrical conductive pin 22 has a hook 221 and a protrusion 222. Each hook 221 is formed with a bending section 2211.

The light-emitting diode 3 can be restricted or constrained by the positioning portion 121 to be accommodated in the accommodating space 12. The light-emitting diode 3 is a SMT (surface mounted technology) light-emitting diode 31 comprising a substrate 311. The substrate 311 is formed into a rectangular body, but it is not limited thereto. The SMT light-emitting diode 31 is provided around the substrate 311 with a plurality of metallic supports 312 to correspond to the electrical conductive pins 22. The electrical conductive pins 22 are electrically connected to the metallic supports 312.

The shroud 4 is assembled with the base 1. The shroud 4 is a transparent oval casing, but it is not limited thereto. The shroud 4 is provided with outer threads 41. The outer threads 41 are threadedly engaged with the inner threads 14 of the base 1.

The present invention further includes a pressing element 5. The pressing element 5 may be formed on the shroud 4, but it is not limited thereto. The pressing element 5 presses the light-emitting diode 3 and the construction thereof will be described as follows. The shroud 4 tightly abuts against the pressing element 5. The light-emitting diode 3 is restricted or constrained to be fixed to the positioning portion 121, so that the pressing element 5 can press the substrate 311. In this way, the electrical conductive pins 22 can elastically abut against the metallic supports 312.

Figure 2:
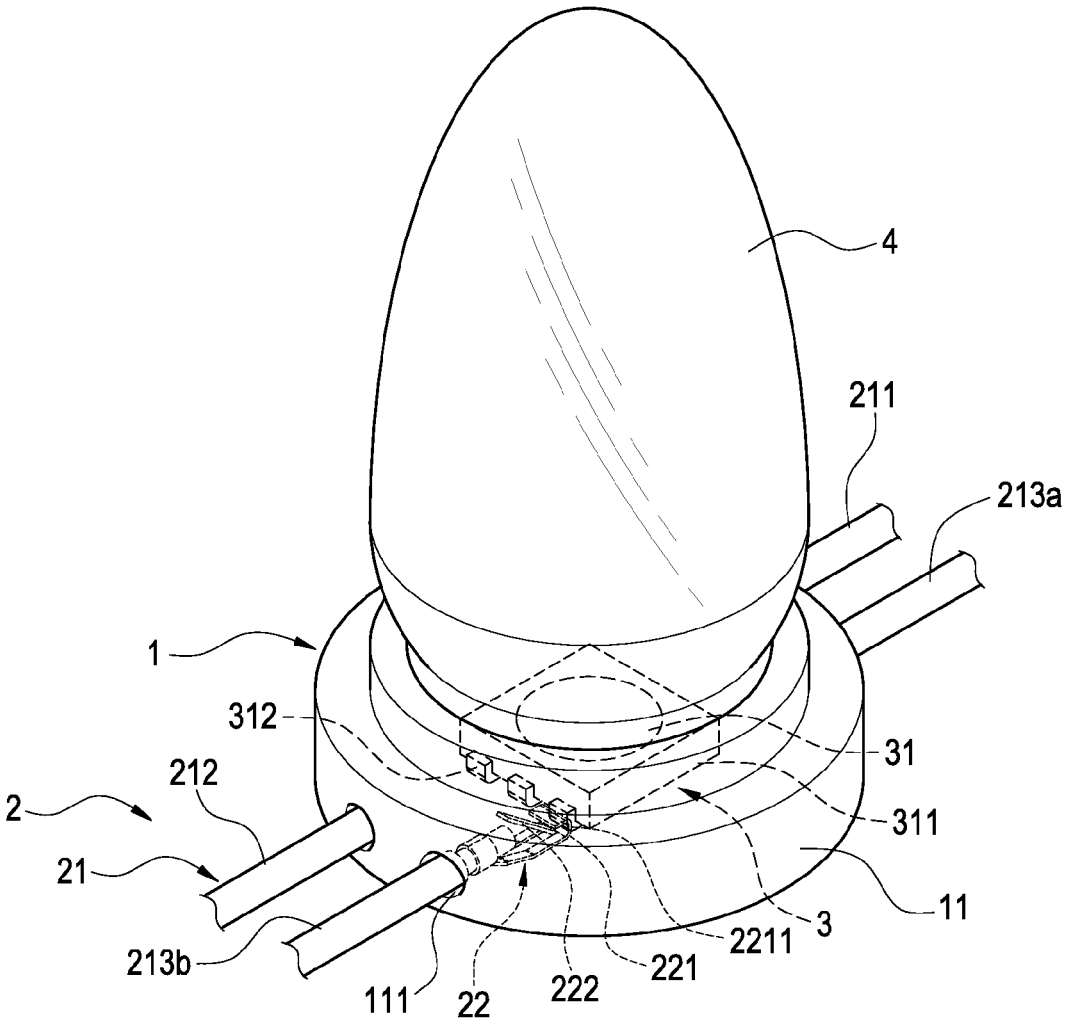
FIG. 2 is an assembled perspective view of the LED light string of the present invention.
Figure 3:
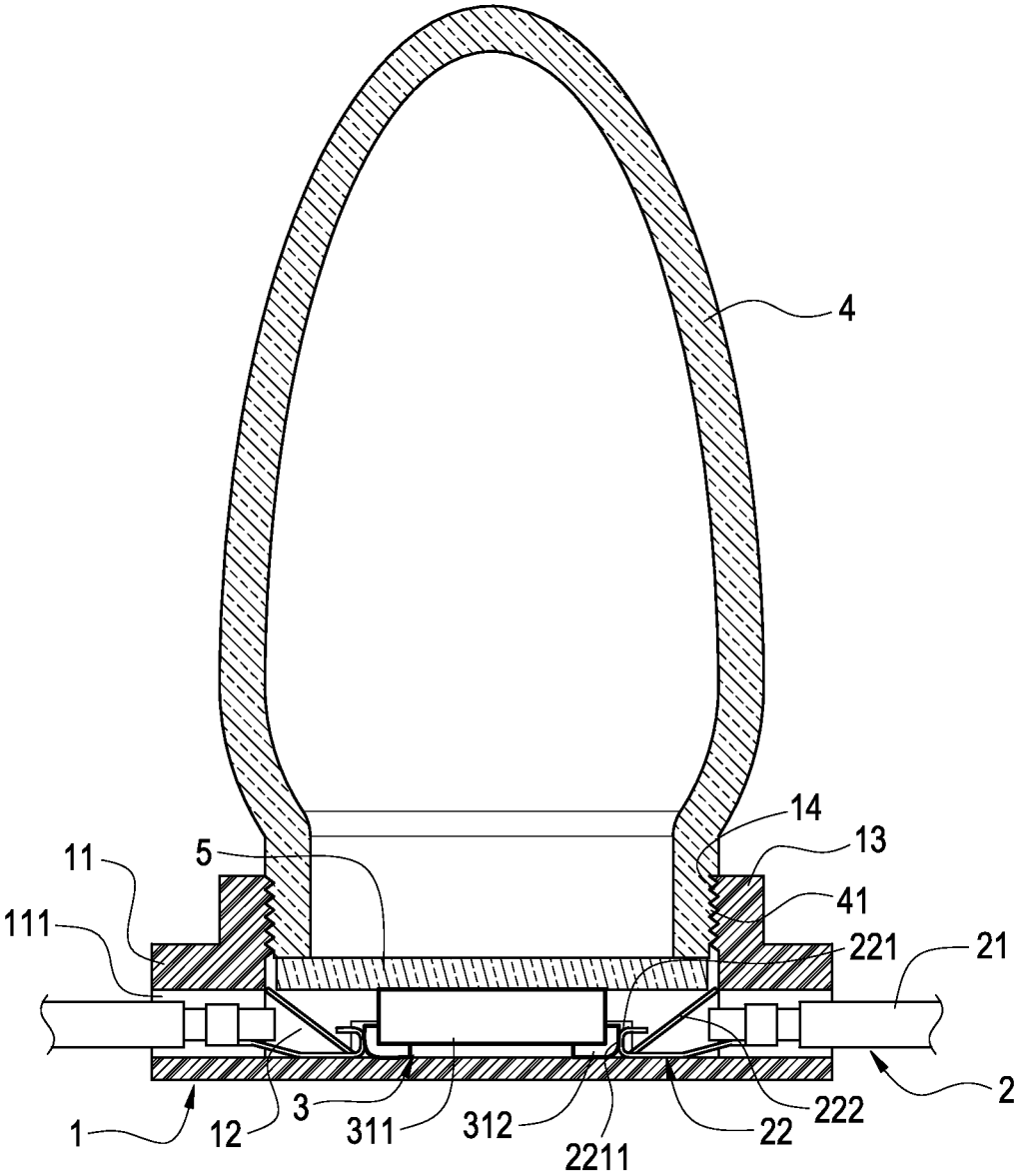
FIG. 3 is a cross-sectional view of the LED light string of the present invention.
Figure 4:
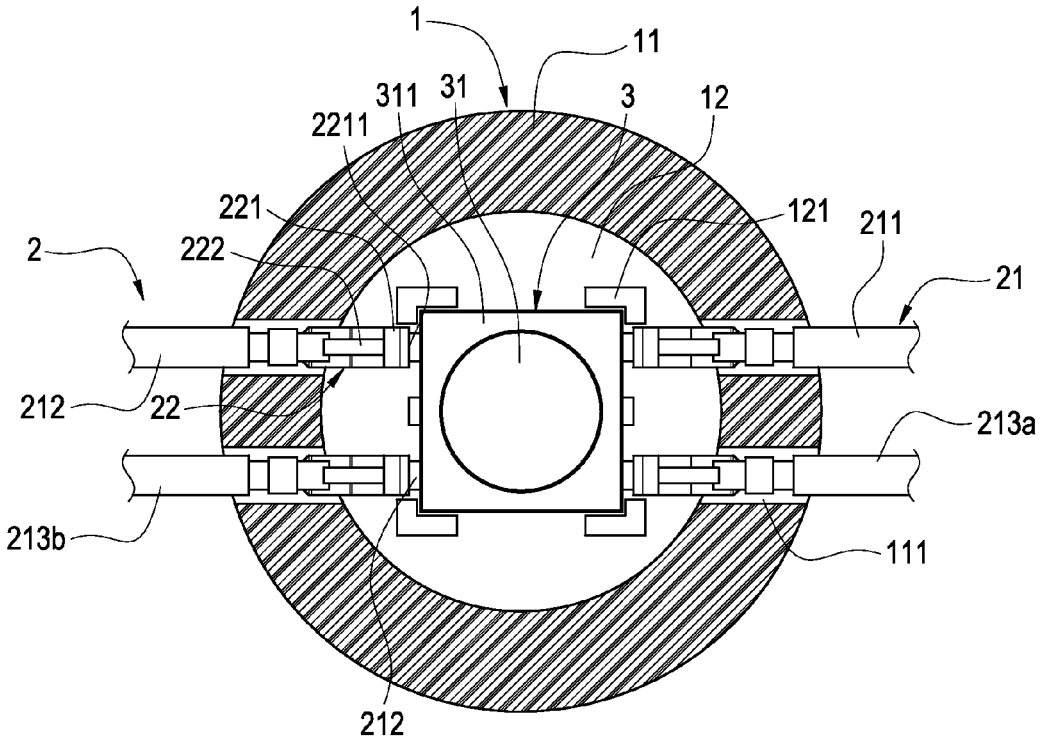
FIG. 4 is another cross-sectional view of the LED light string of the present invention.

Please refer to FIGS. 2 to 4. In assembling the LED light string of the present invention, the peripheral wall 11 of the base 1 is provided with the through-holes 111, and the positioning portion 121 is formed in the accommodating space 12. One end of each electrical wire 21 is connected to each electrical conductive pin 22. The electrical wires 21 and the electrical conductive pins 22 penetrate the through-holes 111 respectively. The distal end of each protruding portion 222 abuts inside the peripheral wall 11, so that the electrical conductive pins 22 are received in the accommodating space 12. Further, the SMT light-emitting diode 31 is restricted or constrained to be fixed to the positioning portion 121, so that the SMT light-emitting diode 31 can be fixedly received in the accommodating space 12 while the metallic supports 312 are brought into contact with the hooks 221 respectively. Finally, the outer threads 41 of the shroud 4 are threadedly engaged with the inner threads 14 of the base 1. The shroud 4 tightly abuts against the pressing element 5, so that the pressing element 5 presses the SMT light-emitting diode 31. When the pressing element 5 presses the substrate 311, the pressing element 5 is used to merely enhance the stability of the light string of the present invention, so that it is not a necessary element. The distal end of each protruding portion 222 abuts against the inside the peripheral wall 11, so that the hooks 221 can be positioned to contact the metallic supports 312 respectively. In this way, the bending sections 2211 can abut against the metallic supports 312, and the SMT light-emitting diode 31 can be firmly fixed in the base 1 while being electrically connected to the electrical conductive elements 2. By this arrangement, the base 1, the electrical conductive elements 2, the light-emitting diode 3, and the shroud 4 of the LED light string of the present invention can be detached and assembled easily. Thus, when the light-emitting diode 3 is damaged, it is convenient for the user to replace or repair the damaged light-emitting diode, which increases the lifetime of the light string. Further, the arrangement of the light strings can be adjusted based on user's demands, which increases the range of use and degree of decoration.

Figure 5:
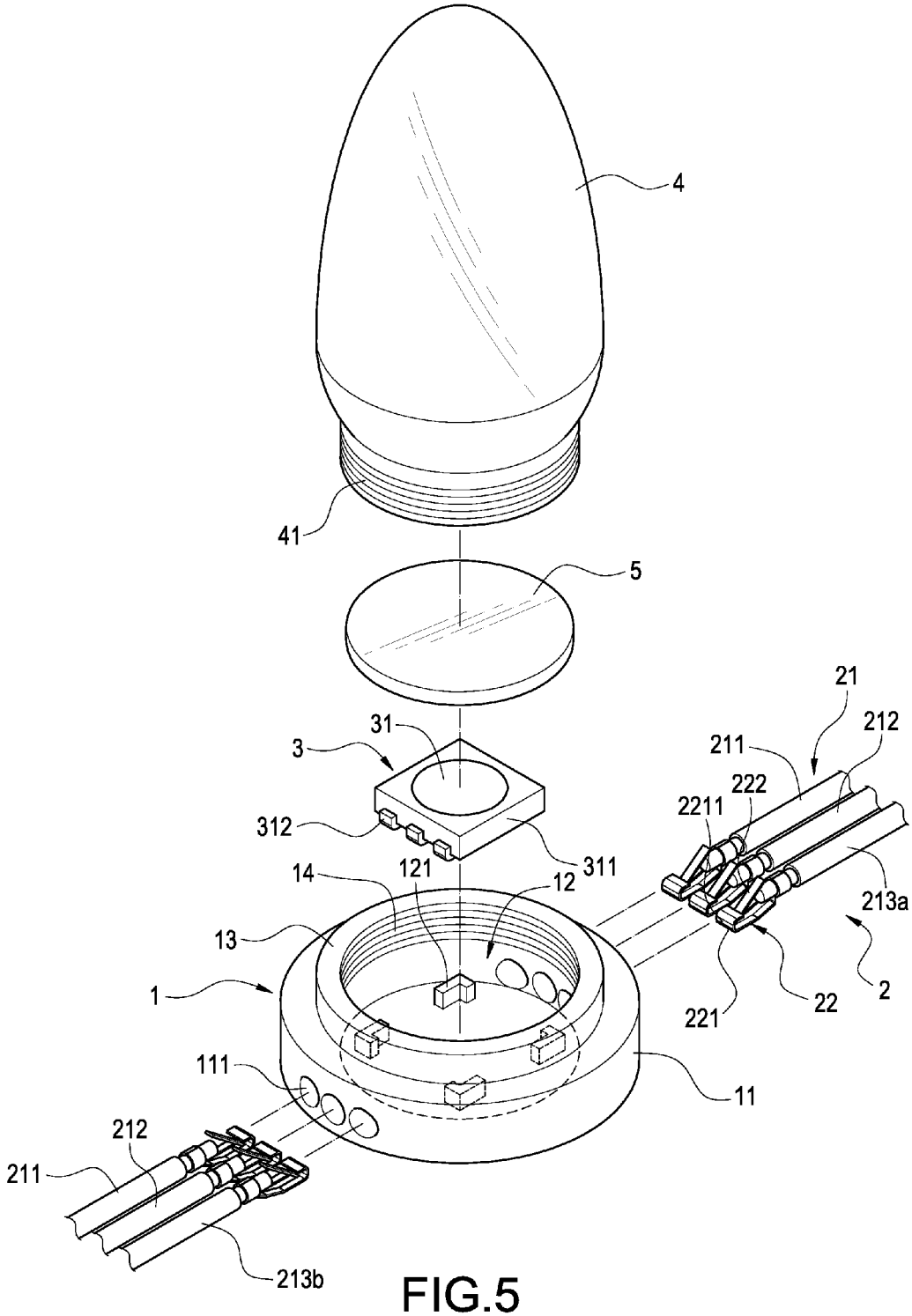
FIG. 5 is an exploded perspective view of the LED light string according to another embodiment of the present invention.

Please refer to FIG. 5, which shows the light string according to another embodiment of the present invention. The through-holes 111 are juxtaposed in parallel to each other on two opposite sides of the peripheral wall 11. The through-holes 111 on one side are penetrated by the positive voltage line 211, the negative voltage line 212 and the signal input line 213*a*. The through-holes 111 on the other side are penetrated by the positive voltage line 211, the negative voltage line 212 and the signal output line 213*b*. The interior of the SMT light-emitting diode 31 includes a light-emitting chip and a driving chip. The signal input line 213*a* inputs data signals into the driving chip. The positive voltage line 211 provides a positive biasing voltage to the light-emitting chip, thereby activating the light-emitting chip to emit light. Further, the negative voltage line 212 cooperates with the positive voltage line 211 to form a closed circuit for the light-emitting chip and the driving chip. The signal output line 213*b* is used to output the data signal of the driving chip. The electrical connection for data input/output, the application of biasing voltage, and the electrical grounding are not limited to the above-mentioned ways, and can be performed in other ways based on practical demands. Thus, in the LED light string of the present invention, the signal input line 213*a* and the signal output line 213*b* are used to input/output the data to the driving chip to thereby control the light-emitting chip. In this way, the respective light-emitting diodes of the LED light string of the present invention can shine randomly and synchronously to generate different lighting effects. Furthermore, the present invention can generate more creative lighting effect based on the user's creative thoughts.

Figure 6:
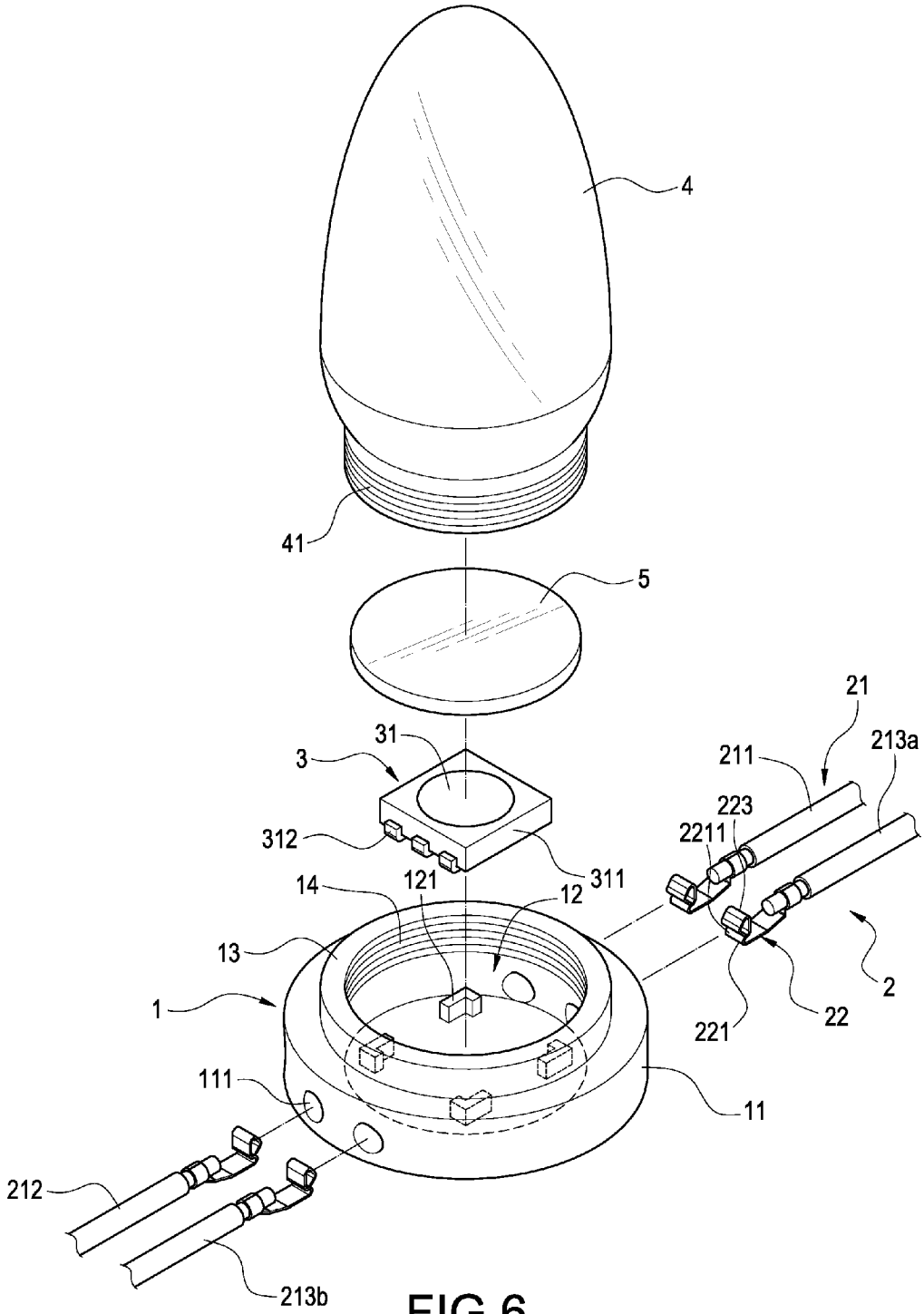
FIG. 6 is an exploded perspective view of the LED light string according to a further embodiment of the present invention.
Figure 7:
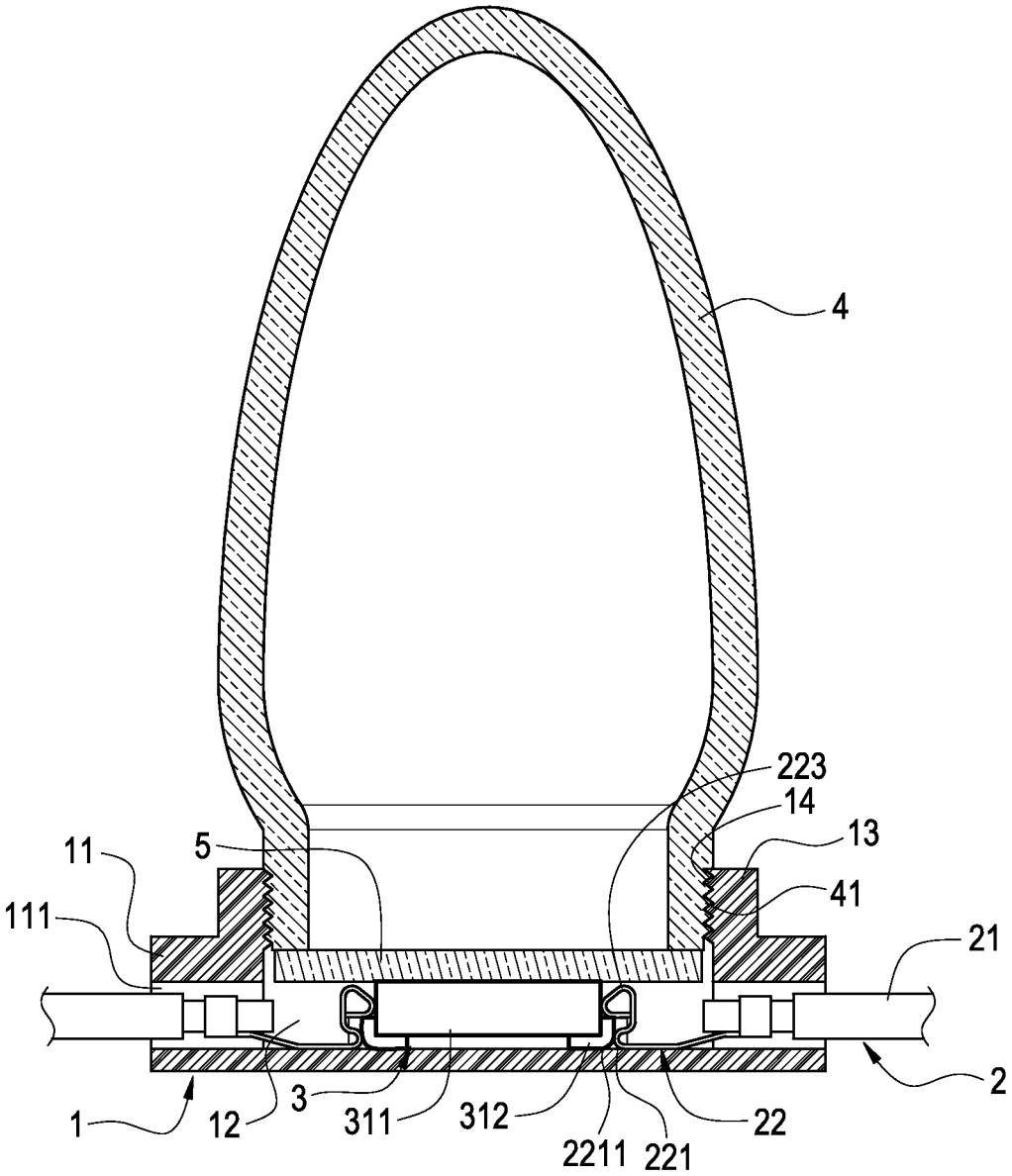
FIG. 7 is a cross-sectional view of the LED light string according to the further embodiment of the present invention.

Please refer to FIGS. 6 and 7, which show the LED light string according to a further embodiment of the present invention. Each electrical conductive pin 22 is provided with an engaging portion 223 extending from the distal end of the hook 221. The engaging portion 223 is bent to form a P shape, but it is not limited thereto. When the SMT light-emitting diode 31 is restricted or constrained by the positioning portion 121, the engaging portions 223 are engaged with the metallic supports 312, so that the engaging portions 223 can abut against the metallic supports 312 respectively. As a result, the hooks 221 are brought into tight contact with the metallic supports 312 respectively in such a manner that the bending sections 2211 abut against the metallic supports 312 respectively. In this way, the SMT light-emitting diodes 31 are electrically connected to the electrical conductive elements 2 firmly, thereby increasing the yield of the light string. It should be noted that, when the pressing element 5 presses the substrate 311, the pressing element 5 is used to merely enhance the stability of the light string. Thus the pressing element 5 is not an essential element.

Although the present invention has been described with reference to the foregoing preferred embodiments, it will be understood that the invention is not limited to the details thereof.

Various equivalent variations and modifications can still occur to those skilled in this art in view of the teachings of the present invention. Thus, all such variations and equivalent modifications are also embraced within the scope of the invention as defined in the appended claims.

What is claimed is:

1. A LED lamp string, including:

a base having a peripheral wall and an accommodating space formed inside the peripheral wall, the peripheral wall being provided with a plurality of through-holes;

a plurality of electrical conductive elements penetrating the through-holes respectively, each electrical conductive element comprising an electrical wire and an electrical conductive pin;

a light-emitting diode fixedly received in the accommodating space, the light-emitting diode having a substrate, and a plurality of metallic supports protruding around peripheries of the substrate and corresponding to the electrical conductive pins, the electrical conductive pins being electrically and directly connected to the metallic supports, respectively, so that the electrical conductive elements are directly contact with the light-emitting diode; and a shroud assembled with the base.

2. The LED lamp string according to claim 1, wherein each electrical conductive pin has a hook, each hook is formed with a bending section, and the bending sections abut against the metallic supports respectively.

3. The LED lamp string according to claim 2, wherein the light-emitting diode is a SMT light-emitting diode comprising the substrate, and the metallic supports are provided around the substrate.

4. The LED lamp string according to claim 1, wherein the base is formed with a positioning portion in the accommodating space, and the positioning portion is fixed to the light-emitting diode.

5. The LED lamp string according to claim 1, further including a pressing element, the interior of the base being provided with a positioning portion, the light-emitting diode being restricted by the positioning portion, the shroud tightly abutting against the pressing element, so that the pressing element presses the light-emitting diode.

6. The LED lamp string according to claim 1, wherein the shroud is provided with outer threads, the base has an open end provided with inner threads, and the outer threads are threadedly engaged with the inner threads.

7. The LED lamp string according to claim 1, wherein the through-holes are juxtaposed in parallel to each other on two opposite sides of the peripheral wall.

8. The LED lamp string according to claim 1, wherein the electrical wires include a positive voltage line, a negative voltage line, a signal input line, and a signal output line.

9. A light-emitting diode (LED) lamp string, comprising:

a base having a peripheral wall and an accommodating space formed inside the peripheral wall, the peripheral wall being provided with a plurality of through-holes;

a plurality of electrical conductive elements penetrating the through-holes respectively, each electrical conductive element comprising an electrical wire and an electrical conductive pin;

a light-emitting diode fixedly received in the accommodating space, the light-emitting diode having a plurality of metallic supports corresponding to the electrical conductive pins, the electrical conductive pins being electrically connected to the metallic supports, respectively; and a shroud assembled with the base, wherein each electrical conductive pin has a hook, each hook is formed with a bending section, and the bending sections abut against the metallic supports respectively, and wherein each electrical conductive pin further has a protruding portion, and a distal end of each protruding portion abuts inside the peripheral wall.

10. A light-emitting diode (LED) lamp string, comprising:

a base having a peripheral wall and an accommodating space formed inside the peripheral wall, the peripheral wall being provided with a plurality of through-holes;

a plurality of electrical conductive elements penetrating the through-holes respectively, each electrical conductive element comprising an electrical wire and an electrical conductive pin;

a light-emitting diode fixedly received in the accommodating space, the light-emitting diode having a plurality of metallic supports corresponding to the electrical conductive pins, the electrical conductive pins being electrically connected to the metallic supports, respectively; and a shroud assembled with the base, wherein each electrical conductive pin has a hook, each hook is formed with a bending section, and the bending sections abut against the metallic supports respectively, and wherein each electrical conductive pin is provided with an engaging portion extending from a distal end of the hook, and the engaging portions are engaged with the metallic supports respectively.

* * * * *